United States Patent [19]

Johnson

[11] 4,331,851

[45] May 25, 1982

[54] PRINTED CIRCUIT BOARD HAVING DATA INPUT DEVICES MOUNTED THEREON AND INPUT DEVICES THEREFOR

[75] Inventor: Larry K. Johnson, North Attleboro, Mass.

[73] Assignee: Texas Instruments Incorporated, Dallas, Tex.

[21] Appl. No.: 159,906

[22] Filed: Jun. 16, 1980

[51] Int. Cl.[3] ..... H01H 13/44

[52] U.S. Cl. ..... 200/159 B; 200/302; 200/5 A

[58] Field of Search ..... 200/5 A, 5 R, 5 E, 159 B, 200/302

[56] References Cited

U.S. PATENT DOCUMENTS

| | | | |
|---|---|---|---|
| 2,262,777 | 11/1941 | Roper | 200/159 B |
| 3,133,170 | 5/1964 | Nanninga | 200/159 B X |
| 3,602,677 | 8/1971 | Adelson et al. | 200/159 B X |
| 3,707,611 | 12/1972 | Twyford | 200/5 E X |
| 3,982,089 | 9/1976 | Hyltin | 200/302 X |
| 4,005,293 | 1/1977 | Borlanger | 200/5 A |
| 4,074,088 | 2/1978 | Keough et al. | 200/159 B X |

FOREIGN PATENT DOCUMENTS

| | | | |
|---|---|---|---|
| 1427971 | 3/1976 | United Kingdom | 200/159 B |

*Primary Examiner*—David Smith, Jr.
*Assistant Examiner*—J. R. Scott
*Attorney, Agent, or Firm*—John A. Haug; James P. McAndrews; Melvin Sharp

[57] ABSTRACT

A printed circuit board is shown having a plurality of data input devices disposed on a face of the board and spaced from one another at selected distances. Each data input device comprises a housing having a flexible electrically conductive disc disposed therein and adapted upon flexure to close a selected circuit path on the board. A flexible gasket is received over an open end of the housing and is captured between the housing and a cover attached thereto. The cover is provided with an aperture therethrough to provide access for a motion transfer member operatively connected to a key member or, alternatively, to permit the button portion of a key member captured between the cover and the gasket to extend therethrough. Stand-off surfaces project from the housing to space the housing from the board to facilitate flushing of the board.

15 Claims, 8 Drawing Figures

PRINTED CIRCUIT BOARD HAVING DATA INPUT DEVICES MOUNTED THEREON AND INPUT DEVICES THEREFOR

BACKGROUND OF THE INVENTION

1. Field of the Invention

This invention relates generally to printed circuit board and more specifically to data input devices particularly useful with printed circuit boards.

2. Description of the Prior Art

Data input devices, in the form of various types of keyboards, have long been available for many different purposes. Commonly such keyboards include a plurality of key switches closely spaced to one another and arranged in an X-Y matrix. The keyboards are made as a separate unit having a substrate which may be a single or double sided circuit board, contacts mounted on the substrate, key buttons, escutcheons and sundry associated housing members. The completed keyboard is frequently provided as a unit for inclusion in the apparatus for which it is intended with the manufacturer of the apparatus having little if any control over the design and manufacture of the keyboard. Such keyboards are typically made in large numbers in order to provide a device having a relatively low cost per key position. Because of the need for maintaining a low cost per key position the keyboards tend to become standardized to utilize mass manufacturing techniques with many different apparatuses using the same or only slightly modified keyboards. For example, for many applications keyboards made in accordance with U.S. Pat. No. 4,005,293 issued Jan. 25, 1977, and assigned to the assignee of the present invention is extremely cost competitive as well as being highly reliable and long lasting. In that patent a plurality of actuating elements or discs are arranged in an array of columns and rows on one face of the substrate and a plurality of parallel extending conductors are mounted on this face of the substrate beneath the actuating elements to form a very compact, inexpensive keyboard system. However, there exists a need for many applications where the number and locations of key positions or data inputs does not conform to a dense array of key positions or where few key positions are required perhaps with differing spacing between key positions. Keyboards made in accordance with the above mentioned patent would not always be cost competitive for such applications. In addition there are situations where the total number of keyboards to be used for a given application is too low in quantity to justify a dedicated design such as that of the above patent.

SUMMARY OF THE INVENTION

An object of the present invention is the provision of an improved data input device and a circuit board for mounting such device.

Another object is the provision of a data input device which can be used singly or in any desired number or switch array pattern while still being economical and reliable. Yet another object is the provision of a data input device which can be assembled conveniently on a circuit board along with various electric components which can all be wave soldered to the board without deleterious effects on the data input device.

Still another object of the invention is the provision of a data input device which has few parts, one which is particularly adaptable to mass manufacturing techniques and one which is effectively sealed from the environment.

Briefly, in accordance with a preferred embodiment of this invention, these and other objects are attained by forming an open ended housing out of a moldable, electrically insulative material having a bottom and side walls with first and second apertures extending through the bottom wall. A disc mounting surface having a first portion in the side wall and has the shape of a portion of an annulus, preferably approximately 180° in extent. A second portion of the disc mounting surface comprises the top surface of a first electrically conductive member disposed on the imaginary continuation of the annulus portion and lying in the same plane as the first portion. A second electrically conductive member is located generally at the center of the annulus and is spaced slightly below the disc mounting surface. A flexible, electrically conductive, snap-acting disc having a perimeter such that it fits on the disc mounting surface is placed thereon so that in its at-rest position the center of the disc does not engage the second conductive member, however, upon flexure of the disc the center of the disc moves with a snap like motion into engagement with the second conductive member. In both the at-rest and flexed positions, a portion of the periphery of the disc engages the first conductive member. The first and second conductive members are preferably identical in size and configuration, each comprising a head and depending shank. A recess is formed in the bottom wall of the housing to conveniently locate the second conductive member below the first conductive member. The shank is provided with an enlarged boss portion extending around its perimeter and located so that it is in alignment with the bottom wall when mounted in respective apertures therein. Ultrasonic energy is used to reflow the housing material around the boss to securely and sealingly mount the shanks in the housing. A gasket of moisture resistant, flexible material is placed over the open end of the housing and is captured to the housing by a cover member which is ultrasonically welded to the housing. A centrally located opening is formed in the cover to provide access to the bottom portion of a motion transfer member opertively connected to a key button, or alternatively, to allow the button portion of a key member captured between the cover and the gasket, to pass therethrough. A plurality of stand-off surfaces project from the housing in order to space the housing from a circuit board on which the device is mounted to facilitate flushing of the circuit board incident to wave soldering operations. One or more data input devices are placed on a circuit board such that the shanks extend through apertures provided in the circuit board. These shanks along with leads of various electric components mounted on the obverse side of the circuit board along with the data input devices are then soldered to selected circuit paths on the reverse side of the circuit board.

BRIEF DESCRIPTION OF THE DRAWINGS

A more complete appreciation of the invention and many of the attendant advantages thereof will be understood by reference to the following detailed description when considered in connection with the accompanying drawings in which.

Corresponding reference characters indicate corresponding parts throughout the several views of the drawings.

DESCRIPTION OF THE PREFERRED EMBODIMENTS

Figure 1:
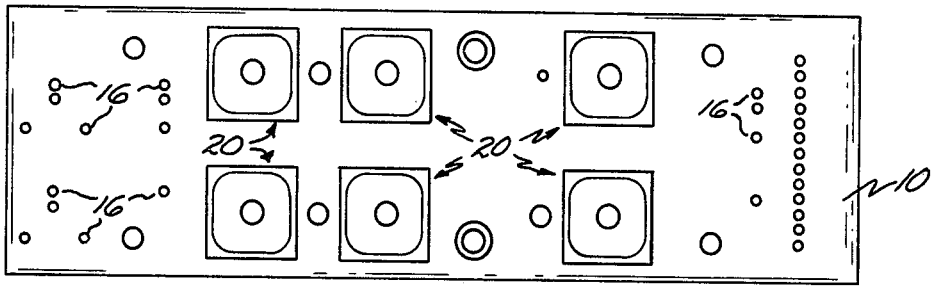
FIG. 1 is a top plan view of a printed circuit board on which are mounted several data input devices made in accordance with the invention.
Figure 2:
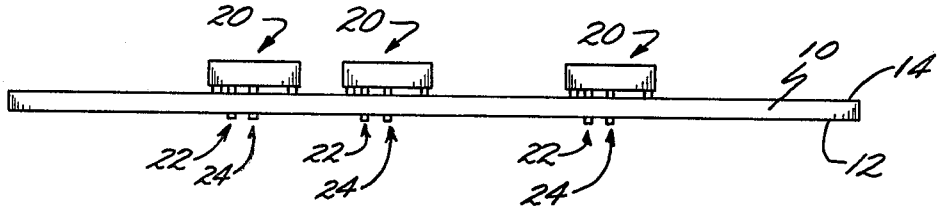
FIG. 2 is a front elevational view of the FIG. 1 board.
Figure 3:
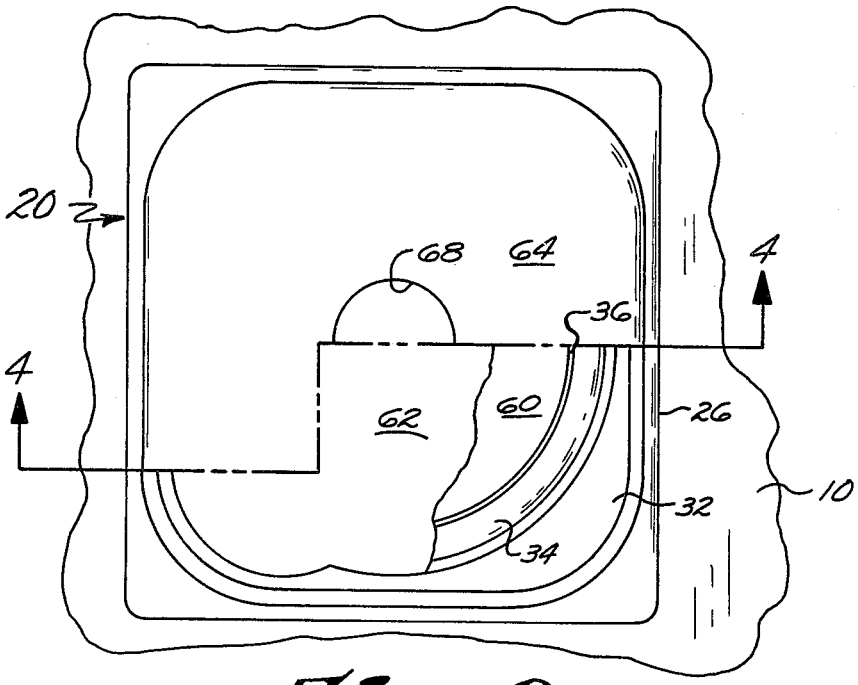
FIG. 3 is an enlarged top plan view, partly broken away, of a data input device seen in FIGS. 1 and 2.
Figure 4:
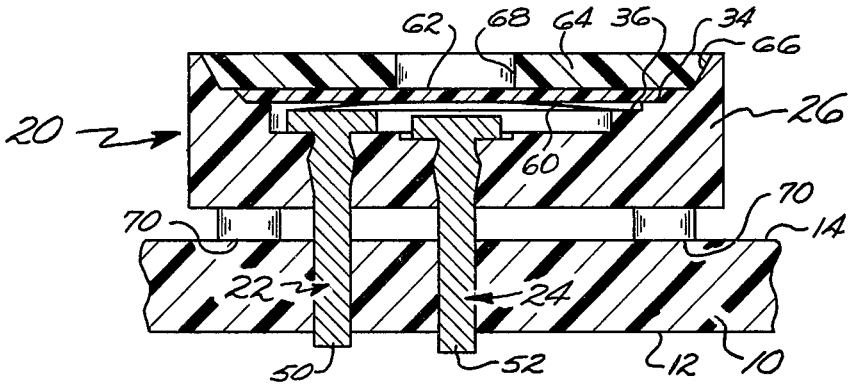
FIG. 4 is a cross-sectional view taken on lines 4—4 of FIG. 3.
Figure 5:
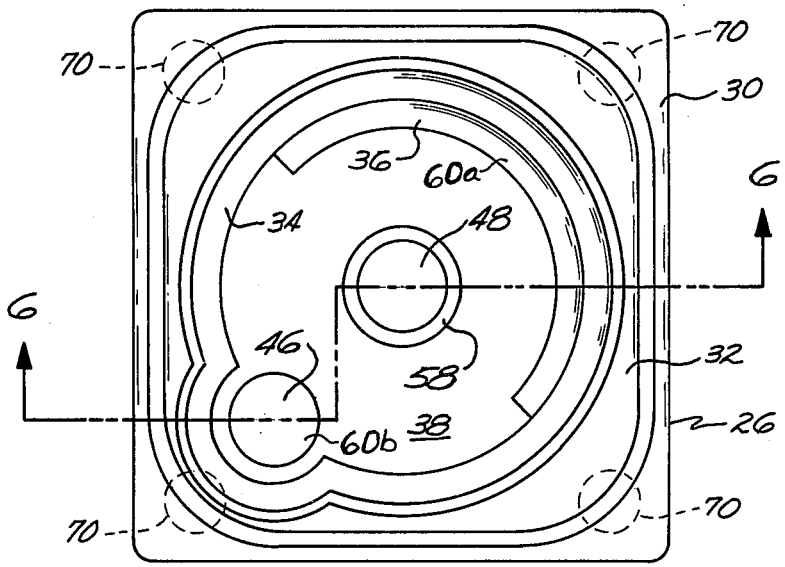
FIG. 5 is an enlarged, top plan view of the housing of the data input device shown in FIGS. 1-4.
Figure 6:
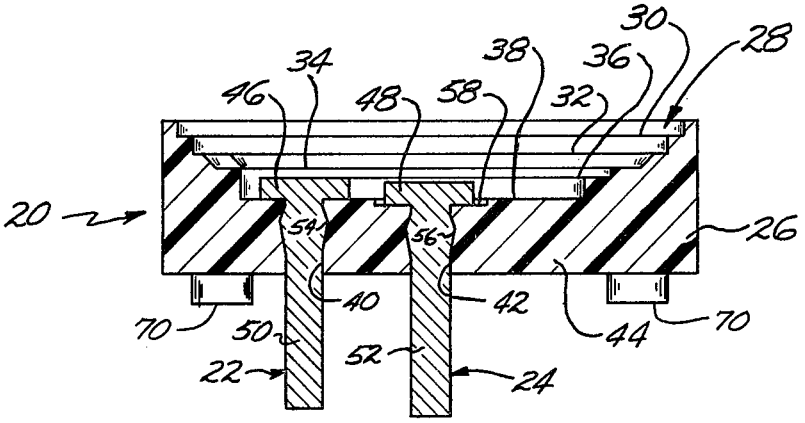
FIG. 6 is a cross-sectional view taken on lines 6—6 of FIG. 5.
Figure 7:
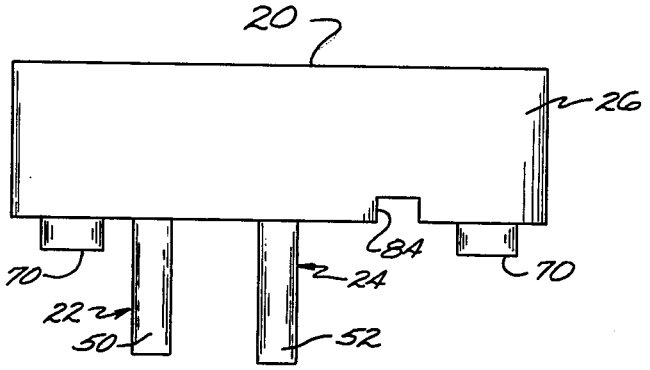
FIG. 7 is a right side elevational view of the data input device.

Referring now to the drawings and especially FIGS. 1 and 2, a printed circuit board 10 has a first obverse face 12 in which printed circuit paths are disposed and a second, reverse, opposite face 14 adapted to receive various electrical components. That is, apertures 16 are located, relative to selected circuit paths on face 12, such that components such as resistors, capacitors and the like, can be mounted on face 14 with leads from the components extending through respective apertures 16, which leads are then soldered, as by wave soldering, to selected circuit paths on face 12.

Also disposed on face 14 are a plurality of single position, single pole data input devices 20 each of which is provided with conductive pin members 22, 24 which extend through appropriate apertures on board 10 for electrical connection to selected circuit paths on face 12, as by wave soldering in the same manner as the other above mentioned electric components.

As seen in FIGS. 3-6 data input devices 10 each comprise a generally rectangular housing 26 of electrically insulative molded synthetic resinous material such as a glass filled VALOX, a trademark of General Electric Company for polyester, having an open end 28 with a series of annular steps 30, 32, 34 and 36 formed in the side wall and a bottom surface 38. Apertures 40, 42 extend from bottom surface 38 through bottom wall 44 for reception therethrough of respective first and second electrically conductive pin members 22, 24.

Pin members 22, 24 are preferably identical in configuration each having a contact head integrally formed respectively with a shank portion 50, 52 and an enlarged annular boss 54, 56 on the shank adjacent to but spaced from head 46, 48 such that when mounted in apertures 40, 42 the bosses are aligned with bottom wall 44. A slight recess 58 is formed in bottom surface 38 so that head 48 is disposed slightly lower than head 46 for a purpose to be described below. Pin members 22, 24 are made of good electrically conductive material such as a CDA 757, a brass alloy designated by the Copper Development Association.

A disc mounting surface located in housing 26 comprises a first portion 60*a* formed of step 36 which is shaped as a discontinuous portion of an annulus which preferably extends approximately 180°. In certain cases it may be desired to employ several portions of annulus 36 rather than one continuous surface portion. Lying in the same plane as the top surface of discontinuous annulus 36 and opposite thereto is the top surface of head 46 of pin member 22 which serves as a second portion 60*b* of the disc mounting surface. Aperture 40 and hence pin member 22 is located generally on the imaginary extension of the discontinuous annulus 36. Aperture 42, and hence pin member 24, is located generally at the center of the annulus 36 and, as mentioned above, due to recessed portion 58, is disposed somewhat lower than pin member 22.

A generally circular-shaped, snap-acting, electrically conductive disc 60 has a diameter selected so that the peripheral edge fits on the first and second portions 60*a* and 60*b* of the disc mounting surface. The discs may be made of a suitable brass alloy such as CDA 688 (a designation of the Copper Development Association) and are shown to be domed having an inner concave face and an outer convex face. These discs are flexible or resiliently deformable from a first or at-rest position (see FIG. 4) in which the outer margin of the disc is in electrical engagement with the first electrically conductive pin member 22 and in which it is spaced from the second electrically conductive pin member 24 and a second or flexed position in which the outer margin of the disc remains in engagement with pin member 22 and in which the central portion on the lower surface of disc 60 engages pin member 24 thereby to complete a circuit between the two pin members. Upon being released, the disc will snap back to its at-rest convex position.

Step 34 forms a gasket seat and receives thereon a flexible gasket 62 to close and seal the open end of housing 26. Gasket 62 is preferably formed of a moisture resistant material such as natural rubber. Gasket 62 is captured in its seat by cover member 64 which conveniently may be formed of the same material as housing 26 and is attached thereto along the peripheral margin of cover 64 by any convenient means such as by ultrasonic welding. In ultrasonically welding cover 64 to housing 26 it will be noted that step 30 of housing 26 (see FIG. 6) loses its specific identity and coalesces with cover 64 along generally chamfered surface area 66 (see FIG. 4) to thereby securely attach cover 64 to housing 26.

An opening 68 is centrally located in cover 64 in order to provide access for a motion transfer member operatively connected to a key member (not shown).

Stand-off surfaces 70 project from the bottom of housing 26 in order to facilitate flushing of the circuit board incident to wave soldering of shanks 50, 52 of pin members 22, 24 to selected circuit paths on face 12 of circuit board 10.

Thus it will be seen that any desired number of data input positions can conveniently be designed in a circuit pattern of a circuit board utilizing the data input device of the present invention while still achieving the economies of mass production techniques. Additionally, any particular circuit board need not be produced in large numbers to obtain the benefit of these techniques since the same data input device can be used for many different applications and thereby realize production of the device in large numbers.

Figure 8:
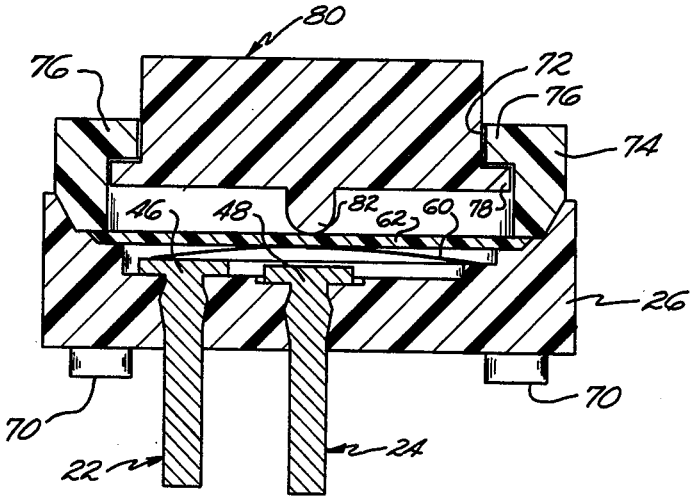
FIG. 8 is a cross-sectional view, similar to FIG. 4 but not showing circuit board 10, of an alternate embodiment of the invention.

In some instances it may be desirable to include the key member in the data input device. As seen in FIG. 8 this may be accomplished conveniently by providing a somewhat larger opening 72 in a cover member 74. Top wall 76 of cover member 74 cooperates with an outwardly extending flange 78 to capture key member 80 between cover 74 and gasket 62. A motion transfer member 82 projects from key member 80 and is disposed over the central portion of disc 60. Thus depression of key member 80 will transfer motion through motion transfer member 82, gasket 62 to disc 60 and cause it to flex so that the central portion of the disc will move toward head 48 of conductive pin member 24.

The data input device as disclosed herein is particularly conducive to mass manufacturing techniques. For instance, a conventional dial table machine can be employed for all assembly and testing operations without any operator intervention, other than to fill the various material hoppers and to be available for normal maintenance. Housings 26 can be fed from vibratory bowls as can pin members 22, 24 and covers 64, 74. The housings 26 are provided with an orientation groove 84 to enable proper orientation of the housings in a fixture on the table using a linear pick and place device. Gaskets 62 and discs 60 can be fed from reels and blanked therefrom.

In one such device made in accordance with the invention disc 60 was approximately $\frac{3}{8}$ of an inch in diameter with the center portion of the disc having approximately 0.010 inch travel. Head 48 was disposed below head 46 approximately 0.0025 inch to obtain good tactile feel of disc actuation. The materials used for the switch, as identified above, resulted in a data input device which could be wave soldered to a circuit board without any deleterious effects and was moisture resistant to effectively isolate the device from the environment.

By means of the present invention one can take any number of finished data input devices and mount them on the same circuit boards on which various other electrical components are placed and then subject both the data input devices and the other electrical components to a conventional wave soldering operation. In the prior art as typified by the aforementioned U.S. Pat. No. 4,005,293, it was generally required to mount the electrical components on a separate circuit board, or if individual switches were used they were not conducive to wave soldering operations. Assembly of the data input devices made in accordance with the present invention can be completely automated, which together with a low parts count, results in an inexpensive, sealed device which can be employed in the same manner as other electrical components.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

We claim:

1. A data input device comprising a housing, formed of electrically insulative, molded material, the housing having bottom and side wall means and an open end, a disc mounting surface spaced a selected distance above the bottom wall means, the disc mounting surface including a first portion formed in the side wall means and a second portion formed of a first electrically conductive member, the first portion being shaped as a discontinuous annular configuration, the bottom wall having first and second apertures extending therethrough, the first aperture located generally on the imaginary continuation of the discontinued portion of the annular configuration, the second aperture located generally in the center of the annular configuration, the electrically conductive member having a shank depending therefrom, the shank extending through the first aperture, a second electrically conductive member having a contact surface and a shank depending therefrom received in and extending through the second aperture, an electrically conductive, snap-acting disc having a diameter selected to fit on the disc mounting surface, a flexible gasket disposed at the open end of the housing and adapted to sealingly close the open end and an cover member having a centrally disposed opening placed over the gasket and attached to the housing to capture the gasket and lock it in place.

2. A data input device according to claim 1 in which the contact surface of the second electrically conductive member is spaced below the disc mounting surface.

3. A data input device according to claim 2 in which the first and second electrically conductive members are identical in size and configuration.

4. A data input device according to claim 2 in which the first and second electrically conductive members have an enlarged boss extending around the perimeter of their shanks at a distance selected such that the boss is in alignment with the bottom wall.

5. A data input device according to claim 2 in which the first and second electrically conductive members are both formed with a head portion of generally the same size from which the respective shank depends, a recessed seat portion is formed in the bottom wall around the second aperture whereby the top surface of the second electrically conductive member is spaced below the top surface of the first electrically conductive member.

6. A data input device according to claim 2 in which stand-off surfaces are provided in the bottom of the housing to facilitate flushing following soldering of the shanks to selected conductive paths on a circuit board.

7. A data input device according to claim 2 in which a key member is captured between the gasket and the cover with a portion of the key member extending through the openings.

8. A data input device according to claim 2 in which the first portion of the disc mounting means extends approximately 180°.

9. A data input device according to claim 2 in which the first and second portions of the disc mounting surface lie in approximately the same plane.

10. A data input device comprising a housing formed of electrically insulative material, a disc mounting surface having a first and second portion lying in approximately the same plane disposed in the housing, the first portion formed generally in the shape of a portion of an annulus, the second portion formed of electrically conductive material and located generally on the imaginary continuation of the annulus, an electrically conductive contact being disposed generally in the center of the annulus, and an electrically conductive flexible disc having an outer peripheral edge adapted to fit on and be supported by the disc mounting surface whereby flexure of the disc electrically connects the second portion of the disc mounting surface and the electrically conductive contact.

11. A circuit board having first and second opposed faces, the first face being adapted to mount thereon selected circuit paths, the second face being adapted to mount thereon selected circuit components, a plurality of apertures formed in the circuit board extending from the first to the second face to facilitate attachment of leads received from components disposed on the second face through respective apertures to selected circuit paths on the first face, at least one data input device comprising a housing formed of electrically insulative material disposed on the second face of the circuit board, each housing having first and second electrically conductive members each having a shank depending therefrom and extending through a respective aperture for connection to a selected circuit path on the first face of the circuit board, a disc mounting surface having a first and second portion lying in approximately the same plane disposed in the housing, the first portion formed generally in the shape of a portion of an annulus, the second portion being formed on the first electrically conductive member and located generally on the imaginary continuation of the annulus, the second electrically conductive member having a contact portion generally disposed in the center of the annulus and an electrically conductive, flexible disc having an outer peripheral edge adapted to fit on and be supported by the disc mounting surface whereby flexure of the disc electrically connects selected circuit paths on the first face through the first and second electrically conductive members and the disc.

12. A circuit board according to claim 11 further including stand off surfaces projecting from each data input device housing adapted to space the housing a selected distance from the second face to facilitate flushing operations.

13. A circuit board according to claim 11 in which the contact portion of each second electrically conductive member is spaced below the plane in which the respective disc mounting surface lies.

14. A circuit board according to claim 11 in which a plurality of data input devices are mounted on the second face with more than one spacing between adjacent devices.

15. A circuit board according to claim 13 in which the portion of the annulus extends approximately 180°.

* * * * *